US006616513B1

(12) United States Patent
Osterheld

(10) Patent No.: US 6,616,513 B1
(45) Date of Patent: Sep. 9, 2003

(54) GRID RELIEF IN CMP POLISHING PAD TO ACCURATELY MEASURE PAD WEAR, PAD PROFILE AND PAD WEAR PROFILE

(75) Inventor: Thomas H. Osterheld, Mountain View, CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 09/826,419

(22) Filed: Apr. 5, 2001

Related U.S. Application Data

(60) Provisional application No. 60/195,523, filed on Apr. 7, 2000.

(51) Int. Cl.[7] ..... B24B 1/00

(52) U.S. Cl. ..... 451/56; 451/287; 451/527

(58) Field of Search ..... 451/56, 41, 259, 451/285–289, 527, 529, 6, 5, 528, 550

(56) References Cited

U.S. PATENT DOCUMENTS

| | | | | |
|---|---|---|---|---|
| 2,073,167 A | * | 3/1937 | Myers | 451/500 |
| 5,014,468 A | | 5/1991 | Ravipati et al. | 51/295 |
| 5,020,283 A | * | 6/1991 | Tuttle | 451/527 |
| 5,022,191 A | * | 6/1991 | Broido | 451/36 |
| 5,152,917 A | | 10/1992 | Pieper et al. | 51/295 |
| 5,243,790 A | * | 9/1993 | Gagne | 451/528 |
| 5,437,754 A | | 8/1995 | Calhoun | 156/231 |
| 5,453,312 A | | 9/1995 | Haas et al. | 428/143 |
| 5,454,844 A | | 10/1995 | Hibbard et al. | 51/295 |
| 5,456,627 A | | 10/1995 | Jackson et al. | 451/11 |
| 5,472,371 A | | 12/1995 | Yamakura et al. | 451/56 |
| 5,486,129 A | | 1/1996 | Sandhu et al. | 451/5 |
| 5,516,400 A | | 5/1996 | Pasch et al. | 156/636.1 |
| 5,527,424 A | | 6/1996 | Mullins | 156/636.1 |
| 5,569,062 A | | 10/1996 | Karlsrud | 451/285 |
| 5,584,789 A | | 12/1996 | Robertson | 493/153 |
| 5,595,527 A | | 1/1997 | Appel et al. | 451/28 |
| 5,605,760 A | | 2/1997 | Roberts | 428/409 |
| 5,618,447 A | | 4/1997 | Sandhu | 438/14 |
| 5,655,951 A | | 8/1997 | Meikle et al. | 451/56 |
| 5,681,217 A | * | 10/1997 | Hoopman et al. | 451/526 |
| 5,692,950 A | | 12/1997 | Rutherford et al. | 451/552 |
| 5,725,417 A | | 3/1998 | Robinson | 451/56 |
| 5,733,176 A | * | 3/1998 | Robinson et al. | 451/41 |
| 5,738,574 A | | 4/1998 | Tolles et al. | 451/288 |
| 5,743,784 A | | 4/1998 | Birang et al. | 451/21 |
| 5,778,481 A | * | 7/1998 | Amsden et al. | 15/102 |
| 5,779,521 A | | 7/1998 | Muroyama et al. | 451/56 |

(List continued on next page.)

FOREIGN PATENT DOCUMENTS

| | | | |
|---|---|---|---|
| EP | 0999013 | 5/2000 | |
| JP | 8-61949 | 12/1996 | |
| WO | WO98/39142 | 9/1998 | B24D/3/28 |
| WO | WO98/45090 | 10/1998 | B24B/53/10 |
| WO | WO98/49723 | 11/1998 | H01L/21/321 |
| WO | WO99/22913 | 5/1999 | |

OTHER PUBLICATIONS

Tobin, et al., USSN 09/523,368, filed Mar. 10, 2000.
Gurusamy, et al., USSN 09/502,560, filed Feb. 10, 2000.
U.S. patent application Ser. No. 09/563,628, Tietz et al., filed May 2, 2000.

*Primary Examiner*—Joseph J. Hail, III
*Assistant Examiner*—David B. Thomas
(74) *Attorney, Agent, or Firm*—Moser, Patterson & Sheridan

(57) ABSTRACT

A method and apparatus for measuring wear of the thickness of a chemical mechanical polishing pad are provided. The apparatus includes a chemical mechanical polishing pad having a plurality of reliefs in a main polishing surface for determining wear of the pad. In one aspect, the pad reliefs comprise through-holes in the pad or extend partially through a thickness of the pad. The method for measuring wear of the thickness of a chemical mechanical polishing pad includes providing a plurality of reliefs in a main polishing surface of the pad and measuring a distance from the main polishing surface to a bottom surface of each of a plurality of the reliefs.

14 Claims, 4 Drawing Sheets

U.S. PATENT DOCUMENTS 5,787,595 A 8/1998 Desai et al. ..... 33/533
5,804,507 A 9/1998 Perlov et al. ..... 438/692
5,810,964 A 9/1998 Shiraishi ..... 156/345
5,820,450 A 10/1998 Calhoun ..... 451/530
5,823,855 A 10/1998 Robinson ..... 451/41
5,833,519 A 11/1998 Moore ..... 451/56
5,842,910 A 12/1998 Krywanczyk et al. ..... 451/41
5,842,912 A 12/1998 Holzapfel et al. ..... 451/72
5,857,899 A 1/1999 Volodarsky et al. ..... 451/72
5,868,605 A 2/1999 Cesna ..... 451/41
5,875,559 A 3/1999 Birang et al. ..... 33/553
5,879,222 A 3/1999 Robinson ..... 451/41
5,879,226 A 3/1999 Robinson ..... 451/287
5,899,745 A 5/1999 Kim et al. ..... 438/692
5,899,800 A 5/1999 Shendon ..... 451/287
5,904,609 A 5/1999 Fukuroda et al. ..... 451/8
5,904,615 A 5/1999 Jeong et al. ..... 451/443
5,906,754 A 5/1999 Appel et al. ..... 216/88
5,908,530 A 6/1999 Hoshizaki et al. ..... 156/345
5,913,713 A * 6/1999 Cheek et al. ..... 451/41
5,916,010 A 6/1999 Varian et al. ..... 451/38
5,916,012 A 6/1999 Pant et al. ..... 451/41
5,921,855 A * 7/1999 Osterheld et al. ..... 451/527
5,934,974 A * 8/1999 Tzeng ..... 451/6
5,941,762 A 8/1999 Ravkin et al. ..... 451/56
5,944,583 A 8/1999 Cruz et al. ..... 451/41
5,951,370 A 9/1999 Cesna ..... 451/21
5,951,380 A 9/1999 Kim ..... 451/65
5,958,794 A 9/1999 Bruxvoort et al. ..... 438/692
5,961,372 A 10/1999 Shendon ..... 451/41
5,975,994 A 11/1999 Sandhu et al. ..... 451/56
5,984,769 A * 11/1999 Bennett et al. ..... 451/527
5,985,090 A 11/1999 Kikuta et al. ..... 156/345
5,990,010 A 11/1999 Berman ..... 438/691
6,001,008 A 12/1999 Fujimori et al. ..... 451/443
6,004,196 A 12/1999 Doan et al. ..... 451/443
6,012,968 A 1/2000 Lofaro ..... 451/39
6,019,670 A 2/2000 Cheng et al. ..... 451/56
6,022,264 A 2/2000 Cook et al. ..... 451/37
6,059,636 A 5/2000 Inaba et al. ..... 451/5
6,069,080 A 5/2000 James et al. ..... 438/691
6,080,046 A 6/2000 Shendon et al. ..... 451/54
6,086,457 A 7/2000 Perlov et al. ..... 451/41
6,093,085 A 7/2000 Yellitz et al. ..... 451/41
6,106,382 A 8/2000 Sakaguchi ..... 451/443
6,106,661 A * 8/2000 Raeder et al. ..... 156/345
6,121,143 A 9/2000 Messner et al. ..... 438/692
6,123,607 A 9/2000 Ravkin et al. ..... 451/56
6,126,517 A 10/2000 Tolles et al. ..... 451/41
6,129,609 A 10/2000 Ripper et al. ..... 451/8
6,168,508 B1 1/2001 Nagahara et al. ..... 451/527
6,186,864 B1 2/2001 Fisher, Jr. et al. ..... 451/6
6,190,236 B1 2/2001 Drill ..... 451/41
6,193,587 B1 2/2001 Lin et al. ..... 451/56
6,196,899 B1 3/2001 Chopra et al. ..... 451/56
6,197,692 B1 3/2001 Fushimi ..... 438/692
6,213,856 B1 4/2001 Cho et al. ..... 451/443
6,241,596 B1 * 6/2001 Osterheld et al. ..... 451/41
6,244,935 B1 6/2001 Birang et al. ..... 451/41
6,273,806 B1 * 8/2001 Bennett et al. ..... 451/527
6,276,996 B1 8/2001 Chopra ..... 451/41
6,277,015 B1 * 8/2001 Robinson et al. ..... 451/285
6,331,137 B1 * 12/2001 Raeder et al. ..... 451/285
6,364,749 B1 * 4/2002 Walker ..... 451/41
2002/0068516 A * 12/2000 Chen et al. ..... 451/285

* cited by examiner

GRID RELIEF IN CMP POLISHING PAD TO ACCURATELY MEASURE PAD WEAR, PAD PROFILE AND PAD WEAR PROFILE

CROSS-REFERENCE TO RELATED APPLICATIONS

This application claims priority from U.S. Provisional Application No. 60/195,523 filed Apr. 7, 2000, which is incorporated herein by reference.

FIELD OF THE INVENTION

The present invention relates to an apparatus for performing chemical mechanical polishing (CMP) during manufacture of a semiconductor device on a semiconductor substrate. The present invention has particular applicability to monitoring CMP to ensure process quality.

BACKGROUND ART

Chemical mechanical polishing (CMP) is a conventional semiconductor device manufacturing technique employed to flatten films, such as interlayer insulating films, and to form metal plugs and interconnections in multiple-layer interconnection processes. As shown in FIG. 1, in a typical CMP apparatus, a rotating holder 12 supports a wafer 14, while a rotating platen 11 holds a polishing pad 17, usually via an adhesive. A first supply nozzle 15 drips a polishing solution in the form of an abrasive slurry onto polishing pad 17, and a second supply nozzle 16 drips water onto polishing pad 17 for rinsing. Typically, pad 17 is larger than wafer 14 (e.g., pad 17 has a 10-inch radius and wafer 14 has an 8-inch diameter), and the wafer and pad are rotated in the same direction at the same speed while they are urged against each other, to effect polishing of wafer 14. Additionally, wafer 14 is typically moved across pad 17 during polishing, but kept away from the center of pad 17 to avoid unwanted torque effects and uneven polishing. As a result, the footprint of polishing pad 17 on wafer 14 during polishing is equivalent to a belt, and the same amount of material is removed across the surface of wafer 14.

As wafer 14 is swept across pad 17 during polishing, some portions of pad 17 may wear to a greater extent than other portions of pad 17. Pad wear is also affected by "conditioning" of the pad, a procedure wherein the polishing pad surface is restored to an abrasive condition after being glazed (i.e., made smoother and less abrasive) by normal use. The unevenness of pad wear is expressed graphically in FIG. 2 as a "wear gradient" line $W_1$. Depending on the conditioning of the pad, wear is likely to be non-uniform; e.g., pad wear may increase towards the outer radius of pad 17, while the center may not wear at all. This is in contrast to the ideal wear gradient $W_2$, which is even across the pad. Disadvantageously, if pad 17 is worn unevenly, whether due to polishing or conditioning, wafer 14 will see a pressure gradient across pad 17 (e.g., less pressure or "load" towards the edge of pad 17), resulting in less polishing at the edge of pad 17, and uneven polishing of the wafer surface. Moreover, even if the CMP process parameters are optimized so pad wear is even, the rate of wear changes from pad to pad. Thus, it is desirable for process control purposes to monitor pad thickness in situ.

Prior art techniques for monitoring the condition of CMP polishing pads include removing the pad from the platen, cutting a strip from the pad, and measuring its thickness. A more advanced, non-destructive pad testing methodology comprises running a stylus across the polishing pad while it is attached to the platen to measure the pad's thickness. This method requires that the stylus be stably mounted relative to the pad and platen, and requires that the stylus run across the pad in a reproducible manner, since the stylus must be run across the pad before polishing, and again after polishing, and its measurements compared. However, the reproducibility necessary for accurate measurements can be difficult to achieve. During polishing, the pad is abraded, exposed to the slurry and exposed to water, resulting in different frictional properties across the pad that cause the stylus to rock and produce inconsistent measurements. Furthermore, the relatively rigid polishing pad is often "stacked" with a compliant foam underlayer between the pad and the platen. The underlayer can swell during operation as it absorbs liquids such as water and/or slurry, and can become compressed during polishing due to the pressure applied between the pad and the wafer, thereby adversely affecting the accuracy of pad thickness measurements.

An improved methodology for inspecting pad wear is disclosed in copending U.S. application Ser. No. 09/338,357, filed Jun. 22, 1999, wherein a pad wear profile is generated using a contactless displacement sensor, such as a laser displacement sensor. The method of the copending application solves some of the problems inherent in stylus-type pad measurement techniques; however, the measuring apparatus must still be stably mounted relative to the pad, and reproducibility of measurements is still problematic due to stacking of the pad on a compliant underlayer.

As semiconductor devices become more complex and process windows shrink, the need for in-process monitoring of manufacturing techniques such as CMP has become increasingly critical. There exists a need for a simplified, accurate methodology for monitoring CMP pad wear and pad wear profile, thereby reducing manufacturing costs and increasing production throughput.

SUMMARY OF THE INVENTION

An aspect of the present invention is a simplified method of monitoring pad wear, pad profile and pad wear profile that does not depend on location of the pad or location of the measuring device for accuracy.

Additional aspects and other features of the present invention will be set forth in part in the description which follows and in part will become apparent to those having ordinary skill in the art upon examination of the following or may be learned from the practice of the invention. Aspects of the invention may be realized and obtained as particularly pointed out in the appended claims.

According to the present invention, the foregoing and other aspects are achieved in part by a chemical mechanical polishing pad having a plurality of reliefs in a main polishing surface for determining wear of the pad.

Another aspect of the present invention is a method for measuring wear of the thickness of a chemical mechanical polishing pad, the method comprising providing a plurality of reliefs in a main polishing surface of the pad, and measuring a distance from the main polishing surface to a bottom surface of the reliefs.

Additional aspects of the present invention will become readily apparent to those skilled in this art from the following detailed description, wherein only the preferred embodiment of the present invention is shown and described, simply by way of illustration of the best mode contemplated for carrying out the present invention. As will be realized, the present invention is capable of other and different embodiments, and its several details are capable of modifications in various obvious respects, all without departing from the invention. Accordingly, the drawings and description are to be regarded as illustrative in nature, and not as restrictive.

BRIEF DESCRIPTION OF THE DRAWINGS

Reference is made to the attached drawings, wherein elements having the same reference numeral designations represent like elements throughout, and wherein.

DESCRIPTION OF THE INVENTION

Conventional methodologies for monitoring CMP polishing pad wear either require destruction of the pad, require accurate placement of the pad and measuring device for accuracy, and/or can be adversely affected by the condition of the pad underlayer. The present invention addresses and solves these problems stemming from conventional techniques, enabling monitoring and control of the CMP process to maintain even polishing over a range of changing process conditions.

According to embodiments of the present invention, a plurality of strategically located reliefs are provided in the polishing surface of a CMP polishing pad, the reliefs extending either partially or completely through the thickness of the pad. The reliefs may include trenches in the pad that have an upper "lip" at the surface of the pad and a lower "ledge" at the bottom of the relief. In operation, the reliefs are scanned, as by a conventional stylus-type instrument or a conventional contactless displacement sensor such as a laser. When the stylus or laser scans it, the instrument detects one flat surface (the lip) and then detects another flat surface (the ledge), thus enabling the instrument to accurately measure the depth of the relief independent of the position of the pad or the position of the measuring hardware. The reliefs are scanned before the pad is used and then scanned again after use to measure the difference in the depth of the reliefs, thereby indicating pad wear. Such information is then used to monitor total pad wear, and to generate a pad profile and a pad wear profile.

The present invention provides accurate pad thickness measurements quickly and easily, thereby enabling the pad wear profile to be closely monitored; e.g., measured every 50–100 wafers, in a cost-effective manner. Consequently, process monitoring can be improved by utilizing the present invention in a feedback loop to reduce variation in process quality, to indicate that process changes are required, and to modify conditioning residence times, conditioning load and/or relative conditioning velocity as a function of pad location.

Figure 1:
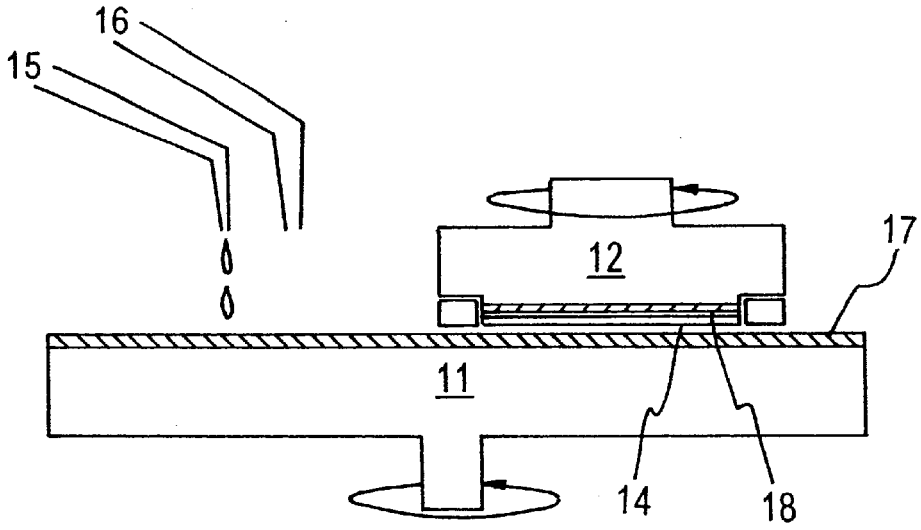
FIG. 1 illustrates a conventional CMP apparatus.
Figure 2:
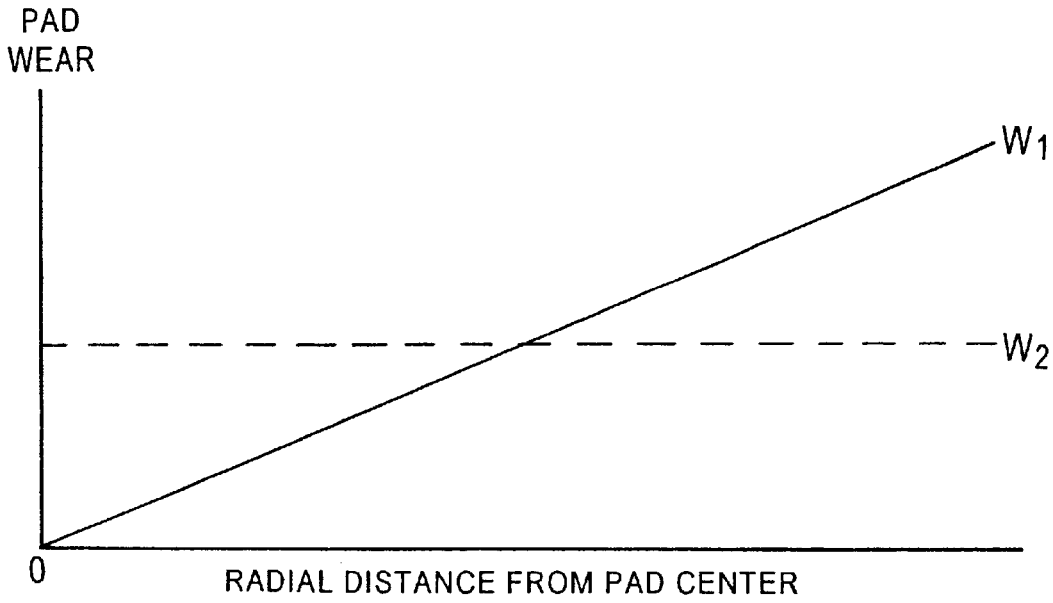
FIG. 2 graphically illustrates CMP pad wear gradient.
Figure 3A:
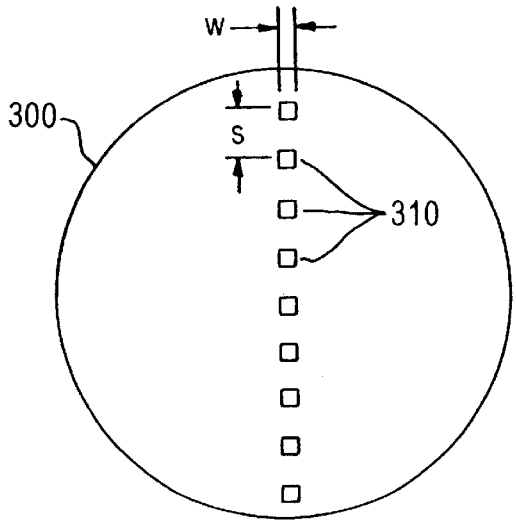
FIG. 3A is a top view of a CMP polishing pad according to an embodiment of the present invention.
Figure 3B:
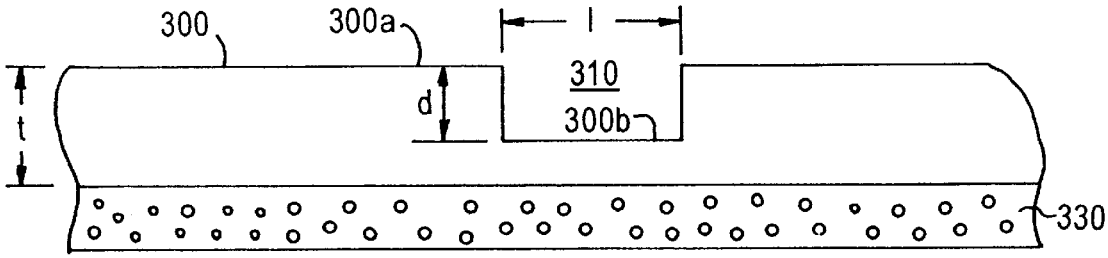
FIG. 3B is a cross-sectional view of a CMP polishing pad according to an embodiment of the present invention.
Figure 3C:
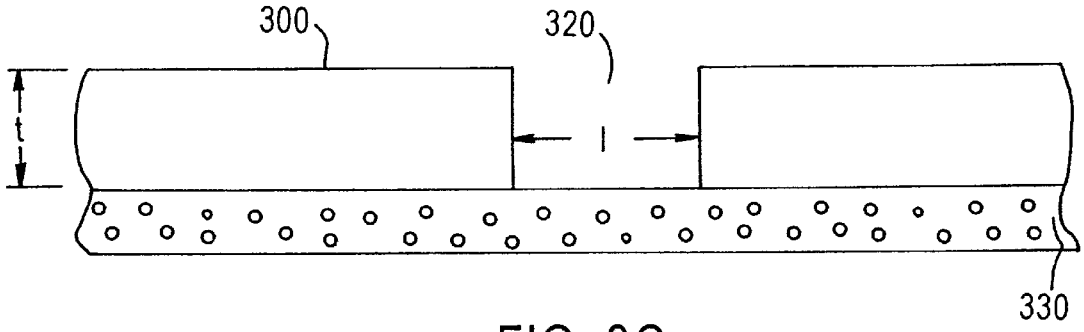
FIG. 3C is a cross-sectional view of a CMP polishing pad according to an embodiment of the present invention.

An embodiment of the present invention is illustrated in FIGS. 3A–3C. Referring to FIGS. 3A–3C, a plurality of reliefs 310 are provided in a predetermined pattern in a conventional polishing pad 300 having a thickness t, such as the IC 1000 polishing pad available from Rodel Corporation of Phoenix, Ariz. Reliefs 310 extend partially through pad 300 to a depth d as shown in FIG. 3B or, in an alternative embodiment of the present invention shown in FIG. 3C, reliefs 320 extend completely through pad 300, exposing underlayer 330. Reliefs 310, 320 can be formed by cutting, embossing or machining pad 300, or are integrally molded with pad 300. Additionally, through-hole type reliefs 320 can be formed by punching or stamping. Reliefs 310, 320 have a length 1, width w and shape (e.g., rectangular, square, triangular, circular) such that they can be probed with a conventional stylus-type instrument such as an LVDT (Linear Velocity Differential Transformer) available from Lucas/Signatone Corp. of Gilroy, CA, or a conventional laser interferometer such as available from MTI Instruments of Albany, N.Y. Reliefs 310, 320 are spaced apart a distance s such that a quantity of reliefs adequate to indicate pad wear accurately are provided. For example, when pad 300 has a thickness t of about 50 mil, rectangular or square reliefs 310 are formed to a depth d of about 30 mil, width w of about 20 mil to about 500 mi, and length 1 of about 20 mil to about 500 mil, and are spaced about 250 mil to about 10,000 mil apart.

The trench-type reliefs 310 of the embodiment of FIG. 3B can be utilized rather than the through-hole type reliefs 320 of FIG. 3C if a stylus probe is used having a limited range of travel. However, a laser probe can adequately handle deep reliefs and through-hole type reliefs 320. Through-hole reliefs 320 are advantageous in that they enable direct measurement of the physical pad dimension t, although accuracy may be affected by the necessity of measuring to the compliant underlayer 330 which, as discussed above, is compressible, and may swell due to absorption of liquid. Trench-type reliefs 310 avoid dependence on underlayer 330 since the measurement of depth d of trench-type reliefs 310 is made from one stable surface 300*a* to another stable surface 300*b*.

Figure 4:
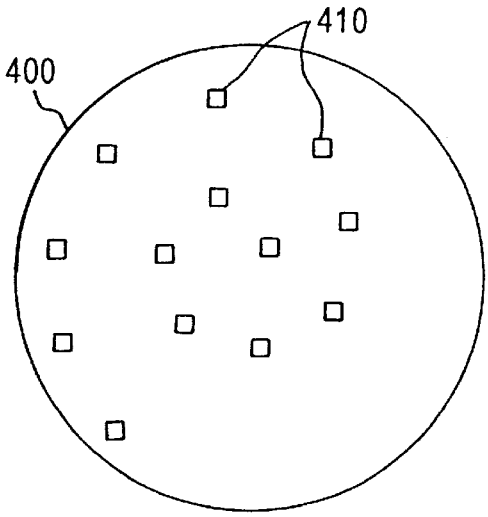
FIG. 4 is a top view of a CMP polishing pad according to an embodiment of the present invention.
Figure 5:
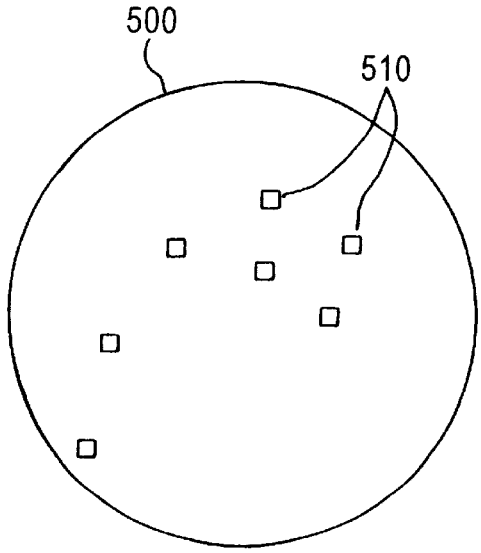
FIG. 5 is a top view of a CMP polishing pad according to an embodiment of the present invention.

Referring to FIGS. 3A, 4 and 5, reliefs 310, 410, 510 can be arranged in a pattern enabling pad wear to be measured at a plurality of locations on pad 300, 400, 500, respectively, such that pad wear profile is determinable as a function of pad radius (e.g., to determine if the pad is wearing more at the outer edge due to sweeping of the wafer relative to the pad during polishing). Furthermore, reliefs 310, 410, 510 can be distributed to also enable development of a two-dimensional pad wear profile; for example, to enable monitoring of whether one portion of pad 300, 400, 500 is wearing at a higher rate than another portion. Such information is useful in determining the evenness of the platen (not shown), the evenness of the pad, the presence of air bubbles under the pad, and the consistency of adhesion between the pad and platen.

Referring again to FIG. 3A, reliefs 310 are arranged along a diameter of pad 300. Thus, the wafer (not shown) "sees" a line of reliefs 310 when it is being polished, and a pad wear profile as a function of pad position is generated using the methodology of the present invention. FIG. 4 illustrates an alternative embodiment of the present invention, wherein reliefs 410 are provided in pad 400 in a spiral pattern. A wafer being polished by pad 400 sees only one relief 410 at a time (rather than the line of reliefs 310 seen by a wafer being polished by pad 300). Thus, the spiral relief pattern distributes pad stress originating from reliefs 410 across the surface of pad 400, avoiding stress concentrations that may arise from the line of reliefs of pad 300. When employing a spiral pattern of reliefs as shown in FIG. 4, the combination of the spiral pattern, rotational speed and wafer sweep can be chosen to avoid having the pattern look like a line to the wafer.

Referring now to FIG. 5, in a further embodiment of the present invention, the pattern of reliefs 510 is a non-symmetrical pseudo-random spiral distribution. This distribution is typically computer-designed and mapped such that the location of each relief 510 is known, and so that reliefs 510 are advantageously located to accurately measure pad wear and pad wear profile without introducing undesirable stress-inducing symmetry into the system.

Figure 6:
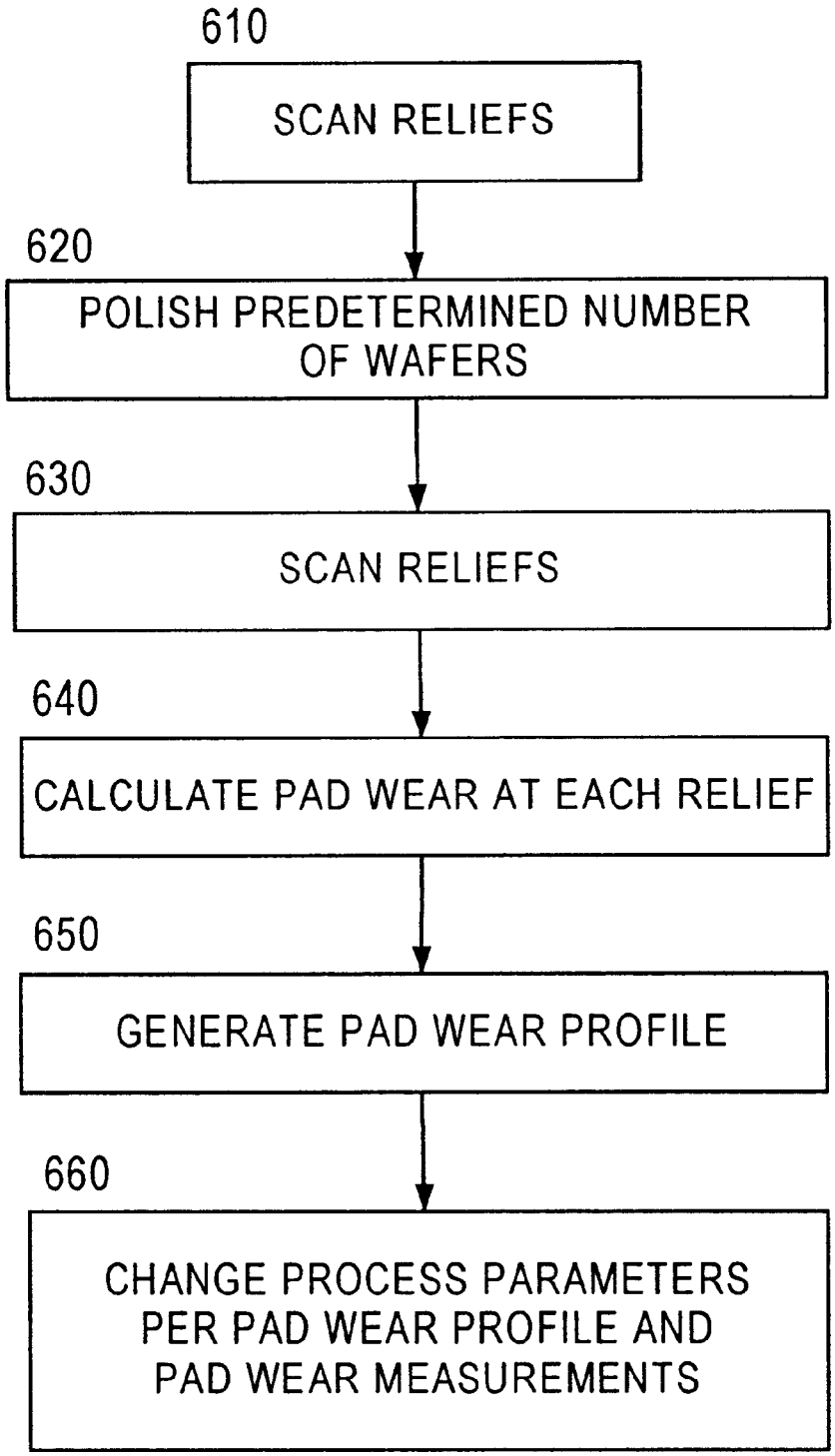
FIG. 6 is a flow chart illustrating the methodology of an embodiment of the present invention.

The methodology of an embodiment of present invention will now be described with reference to FIGS. 3A, 3B and the flow chart of FIG. 6. At step 610, the reliefs of a polishing pad (e.g., reliefs 310 of pad 300 in FIGS. 3A and 3B) are scanned, as by a laser interferometer or LVDT stylus, to measure the depth of the reliefs, such as the depth d of relief 310. Polishing pad 300 is then used to polish a predetermined number of wafers at step 620; for example, 50 wafers. Next, at step 630, reliefs 310 are scanned again by the laser or LVDT stylus to measure their depth d. The depth measurements of steps 610 and 630 are used to calculate the pad wear at each relief 310 (see step 640), and the pad wear measurements are used at step 650 to generate a pad wear profile. The calculations of steps 640 and 650 can be carried out electronically by a computer processor.

If the pad wear is unacceptably fast or if the profile is unacceptably non-flat, at step 660 the process parameters are changed for the next group of wafers to be processed by pad 300, as desired by the user. For example, to improve the flatness of the pad wear profile, one or more of the following variables is typically adjusted:

- conditioning residence time, load and/or relative velocity as a function of pad location or pad thickness
- residence time of the wafer over different parts of pad 300 (e.g., more or less time at the edge of pad 300)
- load (pressure) on the wafer vs. location on pad 300 or thickness of pad 300
- rotational velocity of the wafer vs. location on pad 300 or thickness of pad 300
- sweep range of wafer vs. thickness of pad 300 or location on pad 300 (e.g., if a problem occurs at the edge of pad 300, avoid polishing with edge)
- retaining ring pressure vs. pad thickness Thus, the present invention provides a feedback loop to monitor pad flatness, platen flatness, consistency of pad to platen adhesion and the presence of air bubbles between pad and platen, and improve the quality of the CMP process.

The present invention is also useful for controlling pad flatness to attain an ideal pad wear gradient after process parameters that affect pad wear have been changed. For example, pad wear and pad wear profile can be measured by the techniques of FIG. 6 when a different slurry, conditioner or pad is introduced, or after a mechanical change to the apparatus such as a different size pad or wafer.

Still further, the present invention extends the useful life of a polishing pad after pad wear problems have occurred. For example, since the pad wear rates and wear profile is determinable by the present invention, excessively worn areas of the pad can be avoided while "good" areas are used for polishing, rather than discarding the pad. Alternatively, the above-discussed variables can be adjusted based on the pad wear profile or wear rate to maintain the polishing rate at a problematic portion of the pad.

The present invention is applicable to the manufacture of various types of semiconductor devices, particularly high-density semiconductor devices having a design rule of about $0.18\mu$ and under.

The present invention can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present invention. However, it should be recognized that the present invention can be practiced without resorting to the details specifically set forth. In other instances, well known processing structures have not been described in detail, in order not to unnecessarily obscure the present invention.

Various embodiments of the present invention and but a few examples of its versatility are shown and described in the present disclosure. It is to be understood that the present invention is capable of use in various other combinations and environments and is capable of changes or modifications within the scope of the inventive concept as expressed herein.

What is claimed is:

1. A method for measuring wear of the thickness of a chemical mechanical polishing pad, the method comprising:

providing a plurality of reliefs having a bottom surface in a main polishing surface of the pad; and measuring a distance from the main polishing surface to the bottom surface of each of the plurality of reliefs, wherein the plurality of reliefs are disposed in a predetermined pattern such that the wear of the pad is determinable as a function of pad radius.

2. The method of claim 1, comprising determining total pad wear based on the measured distances, wherein the measuring a distance comprises laser measurements.

3. A method for measuring wear of the thickness of a chemical mechanical polishing pad, comprising:

providing a plurality of reliefs having a bottom surface in a main polishing surface of the pad, the reliefs being disposed in a predetermined pattern;

measuring a distance by laser from the main polishing surface to the bottom surface of each of the plurality of reliefs, wherein the pad has a radius; and determining wear of the pad as a function of the pad radius, based on the predetermined pattern and the measured distances, to generate a pad wear profile.

4. A method for measuring wear of the thickness of a chemical mechanical polishing pad, comprising:

providing a plurality of reliefs having a bottom surface in a main polishing surface of the pad, the plurality of reliefs being disposed in a predetermined pattern;

measuring a distance by laser from the main polishing surface to the bottom surface of each of the plurality of reliefs; and determining a wear rate of a first portion of the main polishing surface of the pad based on the predetermined pattern and the measured distances.

5. The method of claim 3, wherein the pad wear is responsive to a process parameter, and further comprising altering the process parameter based on the pad wear profile.

6. The method of claim 5, comprising altering the process parameter based on the pad wear profile such that the pad wear is approximately equal at each of the reliefs.

7. The method of claim 4, comprising polishing an article using a second portion of the pad separate from the first portion when the wear rate of the first portion is significantly greater than a predetermined value.

8. The method of claim 4, wherein the first portion of the pad is used to polish an article at a predetermined polishing rate, and wherein the polishing rate is responsive to a process parameter and the wear rate, the method comprising altering the process parameter based on the wear rate such that the polishing rate is maintained.

9. The method of claim 5, wherein the process parameter comprises conditioning of the pad.

10. An apparatus for chemical mechanical polishing a substrate comprising, a chemical mechanical polishing pad having a plurality of reliefs having a bottom surface in a main polishing surface for determining wear of the pad, wherein the reliefs comprise through-holes in the pad or extend partially through a thickness of the pad; and means for measuring a distance from the main polishing surface to the bottom surface of each of the plurality of reliefs.

11. The apparatus of claim 10, wherein the means for measuring a distance comprise a laser probe.

12. An apparatus for chemical mechanical polishing a substrate comprising, a laser probe; and a chemical mechanical polishing pad having a plurality of reliefs with a bottom surface disposed in a predetermined pattern thereon, wherein the predetermined pattern is configured to indicate a wear of at least one region of the pad with respect to a pad radius.

13. The apparatus of claim 12, wherein the predetermined pattern is configured to enable monitoring of the pad wear to discern whether two or more regions of the pad are wearing at different rates.

14. The apparatus of claim 12, wherein the predetermined pattern is selected from inline, spiral, non-symmetrical pseudo-random, and combinations thereof.

* * * * *

UNITED STATES PATENT AND TRADEMARK OFFICE

CERTIFICATE OF CORRECTION

PATENT NO. : 6,616,513 B1
DATED : September 9, 2003
INVENTOR(S) : Osterheld

It is certified that error appears in the above-identified patent and that said Letters Patent is hereby corrected as shown below:

Column 4,
Lines 12 and 23, please change “length 1” to -- length I --.

Signed and Sealed this

Twenty-fourth Day of February, 2004

JON W. DUDAS
*Acting Director of the United States Patent and Trademark Office*